US006310296B1

(12) United States Patent
Nishi et al.

(10) Patent No.: US 6,310,296 B1
(45) Date of Patent: Oct. 30, 2001

(54) MULTICORE CABLE AND A METHOD OF MANUFACTURING THEREOF

(75) Inventors: Yasushi Nishi; Kiyofumi Tanaka; Morio Suzuki, all of Hadano (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/442,457

(22) Filed: Nov. 18, 1999

Related U.S. Application Data

(62) Division of application No. 09/168,279, filed on Oct. 8, 1998, now Pat. No. 6,009,621.

(30) Foreign Application Priority Data

Oct. 9, 1997 (JP) ..... 9-276856

(51) Int. Cl.[7] ..... H01B 7/08
(52) U.S. Cl. ..... 174/117 F; 174/78
(58) Field of Search ..... 174/117 F, 36, 174/117 A, 78, 74 R

(56) References Cited

U.S. PATENT DOCUMENTS

| | | | | |
|---|---|---|---|---|
| 4,152,226 | | 5/1979 | Mueller . | |
| 4,588,852 | * | 5/1986 | Fetterolf et al. | 174/36 |
| 4,943,688 | * | 7/1990 | VanDeusen et al. | 174/36 X |
| 5,038,001 | * | 8/1991 | Koegel et al. | 174/117 F |
| 5,399,808 | * | 3/1995 | Carter et al. | 174/36 X |
| 5,455,383 | * | 10/1995 | Tanaka | 174/36 |
| 5,554,825 | * | 9/1996 | Parker et al. | 174/117 F |
| 5,872,334 | * | 2/1999 | Trazyik | 174/36 |

FOREIGN PATENT DOCUMENTS

| | | |
|---|---|---|
| 2-037621 | 2/1990 | (JP) . |
| 2641302 | 5/1997 | (JP) . |

* cited by examiner

*Primary Examiner*—Chau N. Nguyen
(74) *Attorney, Agent, or Firm*—Mattingly, Stanger & Malur, P.C.

(57) ABSTRACT

A multicore cable includes a plurality of cables in parallel and is formed by fusion-welding the plurality of cables with a resin jacket. Each of the plurality of cables is formed by winding a shield around a signaling core wire, which is covered with an insulating material, and a grounding core wire. The resin jacket and the shield are stripped so that a stair portion is formed. The stair portion is coated with an electrically conductive adhesive. A vibration is exerted on the grounding core wire, thereby connecting the shield with the grounding core wire with the electrically conductive adhesive. Eventually, the shield and the grounding core wire are bonded with the electrically conductive adhesive. This allows an electrical connection between the shield and the grounding core wire to be maintained in a desirable condition, thus making it possible to suppress a characteristic impedance variation of the signaling core wire caused by an external factor.

9 Claims, 9 Drawing Sheets

| No | FABRICATING PROCESS | WORK FORM |
|---|---|---|
| 1 | CUTTING AND STRIPPING OUTER JACKETS |   |
| 2 | CUTTING INNER JACKETS |   |
| 3 | STRIPPING INNER JACKETS |   |
| 4 | FORMING CORE WIRES |  |
| 5 | CONNECTING CORE WIRES |   |

MULTICORE CABLE AND A METHOD OF MANUFACTURING THEREOF

This is a divisional application of U.S. Ser. No. 09/168,279, filed Oct. 8, 1998 now U.S. Pat. No. 6,009,621.

BACKGROUND OF THE INVENTION

The present invention relates to a method of manufacturing a cable used in a device such as a computer, and more particularly to a method of manufacturing a multicore cable which needs accurate of electrical characteristics.

The multicore cable means a cable which has a plurality of signaling core wires in parallel. In most cases, the individual signaling core wire is covered with an inner insulating layer, and is formed together with a grounding core wire in such a manner that a shield is wound around them.

FIG. 2 shows a cross sectional view of a flat-type multicore cable as an example of the multicore cable used in a device such as a computer. The flat-type multicore cable is constituted by locating a plurality of cables in parallel. The individual cable is formed by paring a signaling core wire, which is covered with an inner insulating layer, with a grounding core wire, and then by winding a shield around the pair thus created. Since the flat-type multicore cable comprises a plurality of signaling core wires, grounding core wires and shields, it is one type of the above-described multicore cable. At the same time, the flat-type multicore cable, in which the plurality of cables are placed transversely in a line, has a flat configuration. In FIG. 2, a signaling core wire 6, which is covered with an inner insulating layer 5, is paired with a grounding core wire 4 provided along a side portion of the inner insulating layer, and a shield 3 of aluminum is wound around the pair, thus forming a shield layer. Moreover, a plurality of the cables, in any of which this shield layer is formed, are arranged in parallel and, with insulation between any two cables being maintained, the cables are fusion-welded using a jacket 2 made of a thermosetting resin.

In many cases, a component such as a connector is connected with one end of this flat-type multicore cable. This allows the flat-type multicore cable to be used in a state of being easily connected with or disconnected from an electronic appliance. JP-A-3-102783 discloses this flat-type multicore cable and a technique for connecting the component such as the connector with the flat-type multicore cable. The connecting steps, as shown in FIG. 4, are as follows: First, the jacket 2 and the shields 3 are cut and stripped, thereby exposing the inner insulating layers 5 and the grounding core wires 4. Second, being careful not to cut the signaling core wires 6, the inner insulating layers 5, which cover the signaling core wires 6, are cut. Third, being careful not to develop a short-circuit between an inner insulating layer 5 and a grounding core wire 4, the inner insulating layers 5 are stripped so as to expose the signaling core wires 6. Fourth, the grounding core wires 4 and the signaling core wires 6 are formed in such a manner as to fit a configuration of terminals 9 of a connector 8. Finally, the grounding core wires 4 and the signaling core wires 6 are connected with the terminals 9, thereby connecting the connector 8 with the flat-type multicore cable.

In the above-mentioned flat-type multicore cable 1, however, improvement has been made concerning the structure thereof and an insulator material of the inner insulating layer 5 so that the flat-type multicore cable 1 can respond to speeding-up of a signal transmission speed accompanied by an enhancement of machine cycle of a computer. In particular, the material of the inner insulating layer 5 is made closer to air so as to lower the permittivity thereof, thereby speeding up a transmission speed of a signal which transmits in the signaling core wire 6. As a result, the inner insulating layer 5 shown in FIG. 2 has become soft and has been found to be easily modified by the winding of the shield 3. This modification makes unstable a contact between the grounding core wire 4 and the shield 3, and especially when a subtle vibration is exerted on the cable, the effect of the poor contact becomes more apparent. This poor contact between the grounding core wire 4 and the shield 3 gives rise to a variation in characteristic impedance of the signaling core wire 6, and this variation in the characteristic impedance causes a failure to occur in the computer.

FIGS. 5A and 5B show variations in the characteristic impedance of the multicore cable. FIG. 5A is a graph representing the characteristic impedance when the cable itself is at rest. FIG. 5B is a graph representing the characteristic impedance when a vibration is exerted on the cable. It can be recognized that, as compared with the characteristic impedance shown in FIG. 5A, the characteristic impedance shown in FIG. 5B is varied more extensively under the influence of the vibration.

As a countermeasure to be taken against this, what can be considered, for example, is that gold with high conductivity is plated on a surface of the grounding core wire 4, thereby maintaining the electrical contact between them. However, this method is an expensive one because of the use of gold plating, and also was not successful in avoiding a problem in that the vibration makes imperfect the contact between the grounding core wire 4 and the shield 3. This poor contact between the grounding core wire 4 and the shield 3 has resulted in a drawback that the multicore cable lacks a reliability in a device such as a computer in which even a subtle variation in the characteristic impedance is not permitted.

SUMMARY OF THE INVENTION

It is an object of the present invention to obtain a multicore cable which, by securely connecting the grounding core wire 4 with the shield 3, makes it possible to maintain, even in a state of vibration, a stable characteristic impedance as is shown in FIG. 5A.

In order to accomplish the above-described purpose, in the present invention, as is shown in FIG. 1, incisions are cut into the jacket 2 and the shields 3 of the multicore cable 1 in such a manner that a stair difference is formed between the upper and the lower parts thereof, and then the stripping of the jacket 2 is performed. Moreover, an electrically conductive adhesive 7 is coated between an exposed shield 3 and an exposed grounding core wire 4, thereby bonding the shield 3 and the grounding core wire 4. At this time, if an ultrasonic wave vibration is exerted on the grounding core wire 4, even if oxide films are formed on a surface of the shield 3 and on a surface of the grounding core wire 4, it becomes possible to eliminate the oxide films. Also, the ultrasonic wave vibration allows the electrically conductive adhesive 7 to penetrate between the grounding core wire 4 and the shield 3 in a right degree. This increases a connection area between them, thus making it possible to securely perform the connection therebetween. As a result, even in a state in which a vibration is exerted on the multicore cable 1, it is possible to obtain a stable characteristic impedance.

DESCRIPTION OF THE PREFERRED EMBODIMENTS

Using FIG. 8A to FIG. 8C, the explanation will be given below concerning the content of the present invention.

Figure 8A:
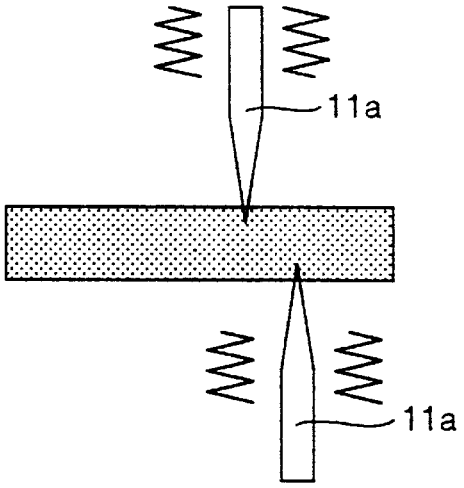
FIG. 8A is a diagram showing a manner in which a jacket and shields in the multicore cable are cut.

FIG. 8A is a diagram for showing a manner in which the jacket 2 and the shields 3 in the multicore cable 1 are cut. FIG. 8B is a diagram for showing a manner in which an electrically conductive adhesive 7 is coated on a cut cross section of a shield 3 with a dispenser 19. FIG. 8C is a diagram for showing a manner in which a vibration is exerted on a grounding core wire 4 with an ultrasonic wave vibrator 20, thus causing the electrically conductive adhesive 7 to penetrate between a shield 3 and the grounding core wire 4.

First, in FIG. 8A, the jacket 2 and the shields 3, i.e. outer jackets of the multicore cable 1, are cut using ultrasonic wave cutters 11*a*. At this time, an ultrasonic wave cutter 11*a* on the upper side and an ultrasonic wave cutter 11*a* on the lower side are located slightly shifted from each other in the core wire direction. The ultrasonic wave cutters 11*a* are moved in a direction perpendicular to the core wire, thereby performing the cutting of the jacket 2 and the shields 3. As described above, since the upper and lower ultrasonic wave cutters 11*a* are located a slightly shifted from to each other, a stair portion is formed in a cut portion of the jacket 2 and in a cut portion of a shield 3.

Figure 3A:
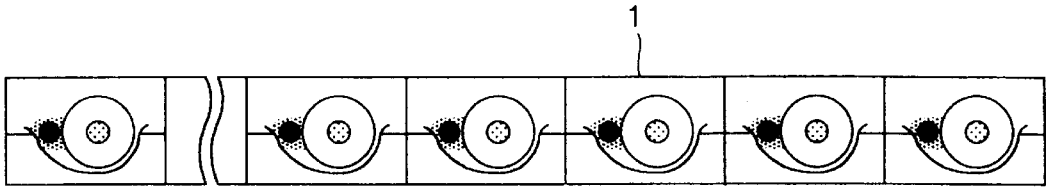
FIG. 3 is a cross sectional view of a structure of the flat-type multicore cable after a jacket is stripped, i.e. an embodiment in the present invention.
Figure 3B:
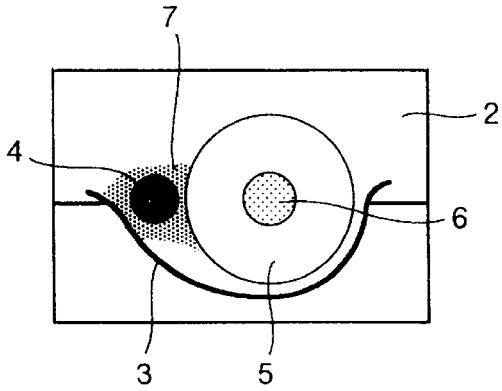
Figure 4:
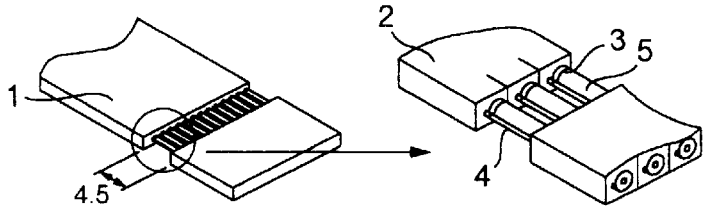
FIG. 4 is a diagram for showing a fabricating process of the flat-type multicore cable.
Figure 4:
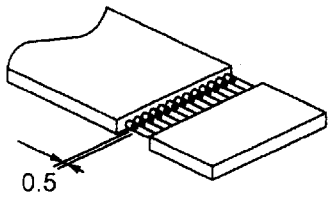
Figure 4:
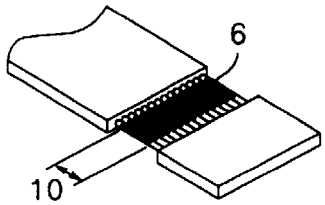
Figure 4:
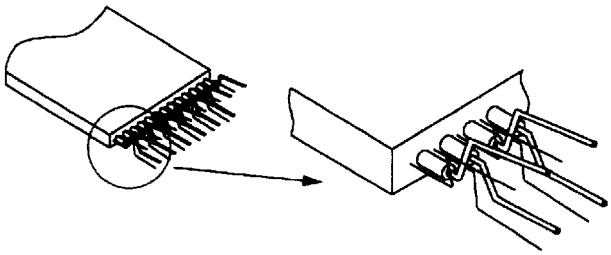
Figure 4:
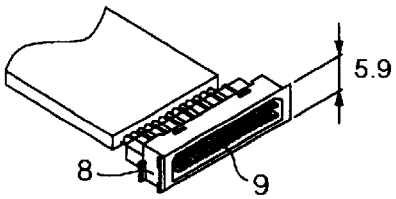
Figure 5A:
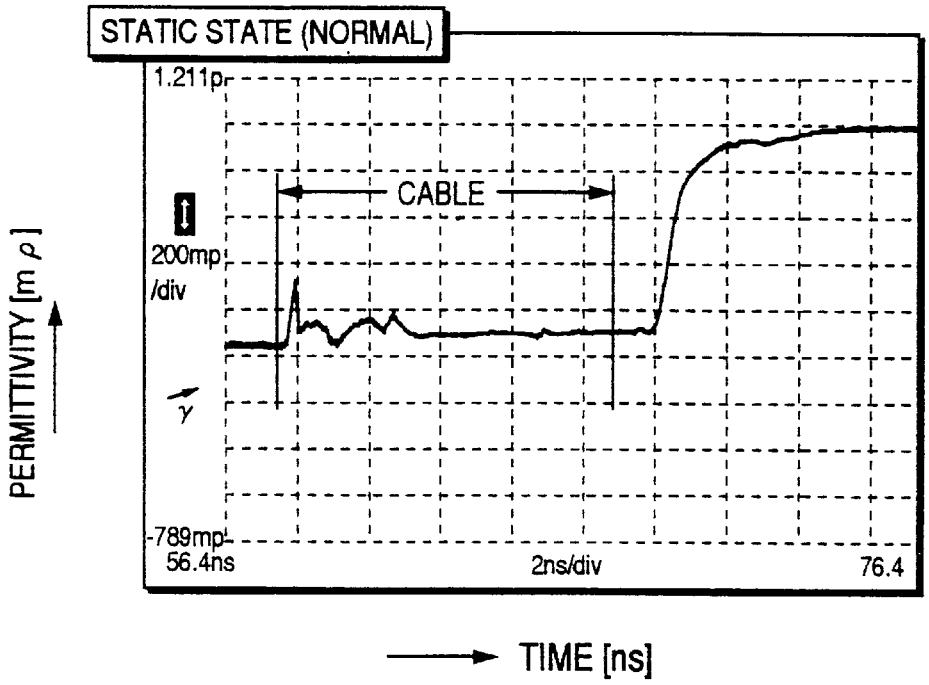
FIGS. 5A and 5B are diagrams which show a characteristic impedance waveform of the cable in a static state and a characteristic impedance waveform of the cable in a state of vibration, respectively.
Figure 5B:
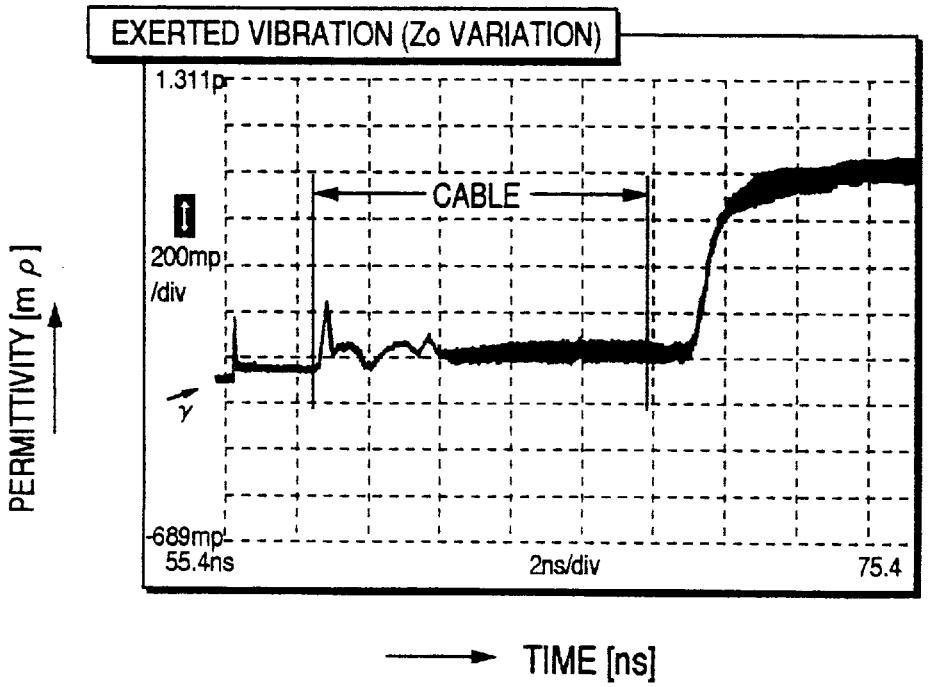
Figure 8B:
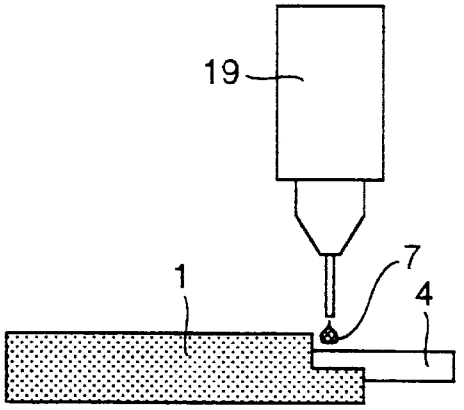
FIG. 8B is a diagram showing a manner in which an electrically conductive adhesive is coated on a cut cross section of a shield with a dispenser.
Figure 8C:
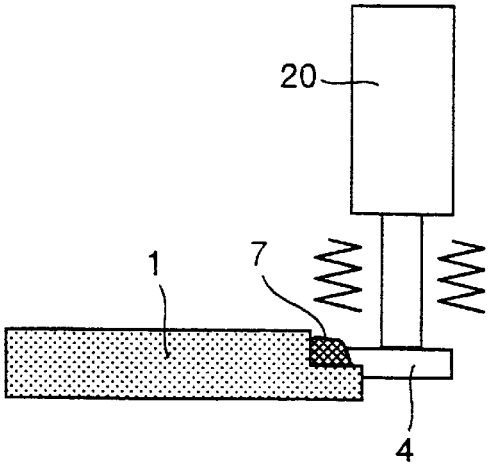
FIG. 8C is a diagram showing a manner in which a vibration is exerted on a grounding core wire with an ultrasonic wave vibrator.

Next, as shown in FIG. 8B, the electrically conductive adhesive 7 is coated on the above-described stair portion by a fixed quantity with the use of the dispenser. As shown in FIG. 3, the shield 3 in the cut portion lies in a state in which the lower half still remains. On account of this, the electrically conductive adhesive 7 penetrates into an inner side of the shield 3, thus bonding the grounding core wire 4 and the shield 3. Furthermore, in this state, as shown in FIG. 8C, an ultrasonic wave vibration of 40 kHz is exerted on the grounding core wire 4 with the use of the ultrasonic wave vibrator 20. This ultrasonic wave vibration causes the electrically conductive adhesive 7 to penetrate between the grounding core wire 4 and the shield 3 ever more deeply, thus making it possible to embody a secure connection between the grounding core wire 4 and the shield 3. Also, the ultrasonic wave vibration shaves contact portions at which the shield 3 and the grounding core wire 4 are in contact with each other. This, when oxide films are formed on surfaces of the shield 3 and the grounding core wire 4, makes it possible to remove the oxide films. It is preferable that frequency of the ultrasonic wave vibration is in a range of 20 to 400 kHz. The reason is that the ultrasonic wave vibration of less than 20 kHz does not exhibit enough permeability, and that of 400 kHz or more is in danger of destroying the components themselves. When employing the ultrasonic wave vibration of 40 kHz as is the case with the present embodiment, a suitable permeability has been obtained and there appears no damage to the components themselves.

The electrically conductive adhesive 7 is a paste-like adhesive produced by mixing electrically conductive metal particles with an adhesive. The example is an epoxy series adhesive containing silver particles. In the embodiment of the present application, a silver paste-like adhesive, which contains substances such as silver particles, Carbitol Acetate and diethylenetriamine, is employed. Also, it is necessary for the electrically conductive adhesive 7 to penetrate between the grounding core wire 4 and the shield 3 with the guide of the ultrasonic wave vibration. Thus, preferably, the electrically conductive adhesive 7 has a low viscosity when it is in a liquid state. In the present embodiment, a desirable result has been obtained at normal temperature (25° C.), using an electrically conductive adhesive of 125 Pa·s. It is also confirmed that an electrically conductive adhesive can be utilized equally well as long as the viscosity thereof is 125 Pa·s or less. The electrically conductive adhesive is produced by mixing electrically conductive particles, i.e. solids, with an adhesive, i.e. a liquid, and thus is highly unlikely to penetrate into spaces such as a minute clearance. However, when minute clearances between the contact surfaces of the grounding core wire 4 and the shield 3 are modified by exerting the ultrasonic wave vibration, the electrically conductive particles enter the minute clearances and diffuse evenly and uniformly. This makes it possible to perform the connection under a condition that the electrical conduction is maintained excellently. Also, on account of the ultrasonic wave vibration, it is possible to perform the connection with little position shift caused between the connection surfaces.

Next, using FIG. 6 and FIG. 7, the explanation will be given below concerning embodiments of apparatuses for carrying out the present invention.

Figure 6:
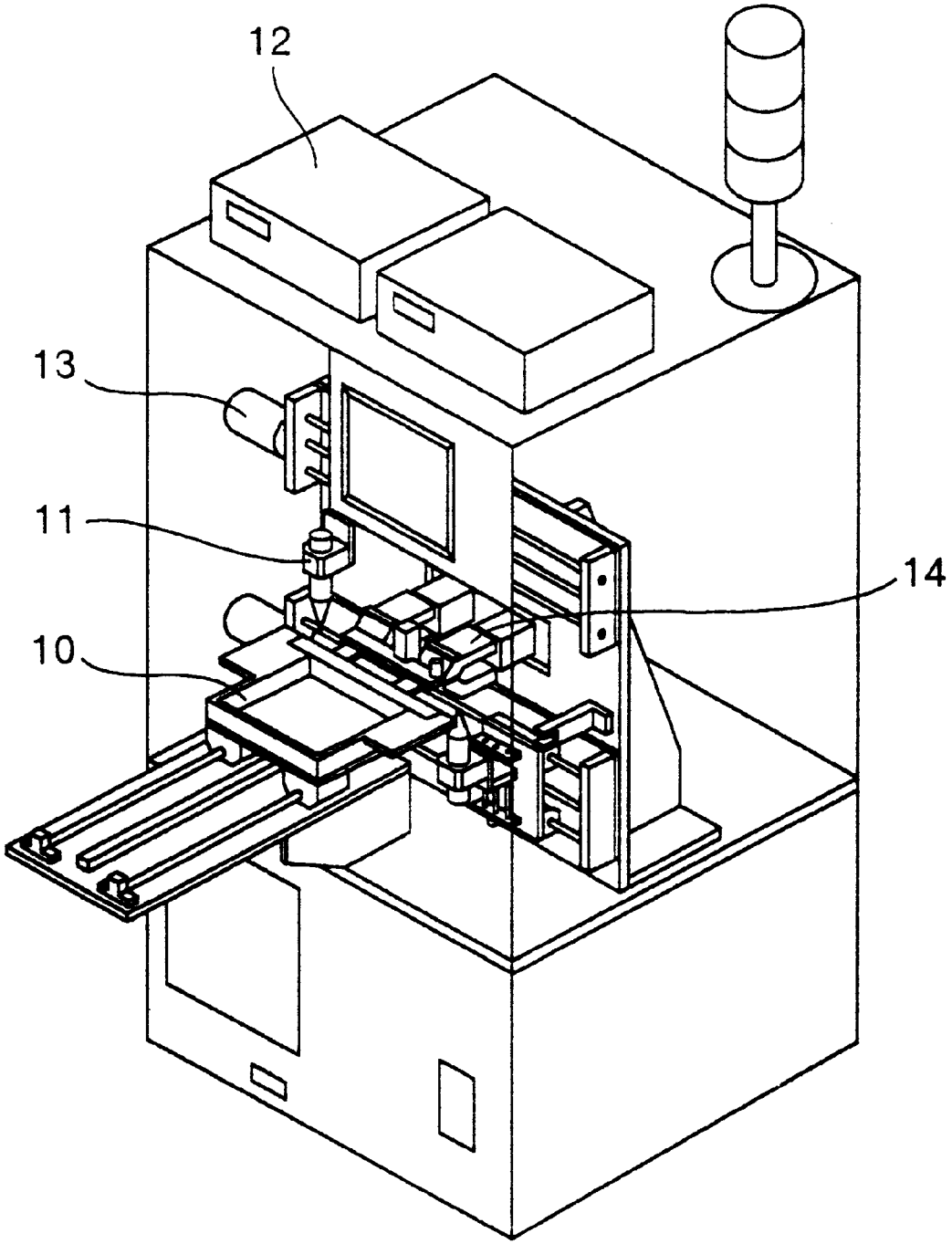
FIG. 6 is a perspective view of an outer jacket stripping apparatus, i.e. an embodiment in the present invention.

FIG. 6 is a perspective view of an outer jacket stripping apparatus for stripping the jacket 2 and the shields 3 so as to expose the inner insulating layers 5 and the grounding core wires 4. A cutter unit 11, which comprises the ultrasonic wave cutters 11*a* for cutting incisions into the jacket 2, and a cutter unit sending mechanism 13, which moves the cutter unit 11 in a transverse direction, are installed on the outer jacket stripping apparatus symmetrically with each other in a vertical direction.

Also, stripping edges 14 for stripping the jacket 2 are installed from the upper and lower sides so that the flat-type multicore cable 1 can be sandwiched therebetween.

Figure 1A:
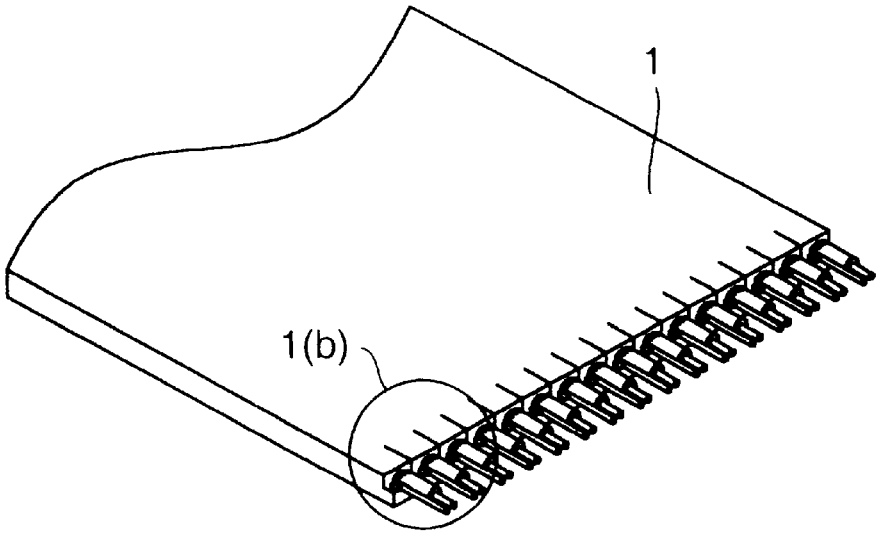
FIG. 1 is a perspective view of a cable connection structure in the present invention.
Figure 1B:
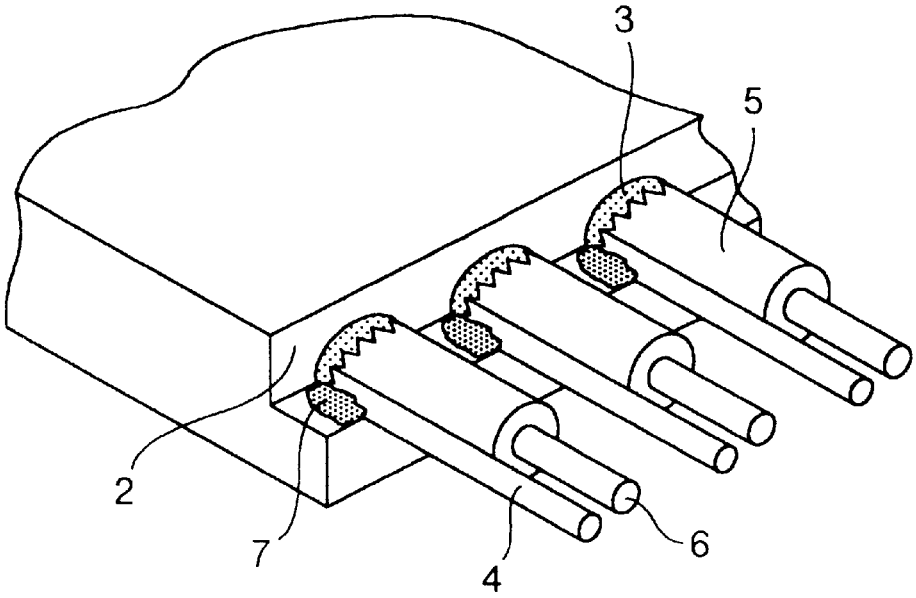
Figure 2A:
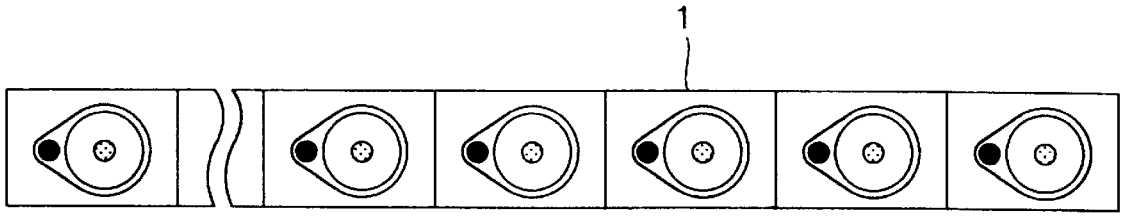
FIG. 2 is a cross sectional view of a structure of a flat-type multicore cable in the present invention.
Figure 2B:
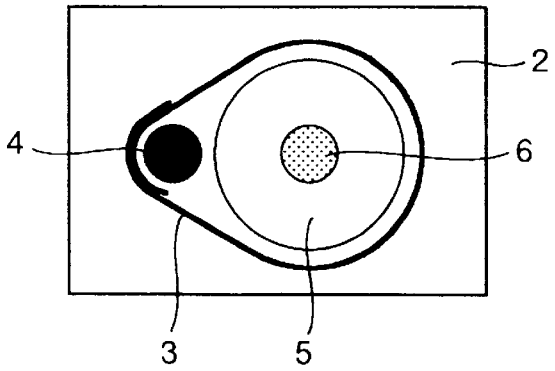

The flat-type multicore cable 1 is mounted, in a state of being wound, on a cable-specified pallet 10. The multicore cable 1 is taken into an inside of the apparatus in a state in which it is fixed in the position alignment on a cable-specified pallet 10. A front end of the cable 1 is sandwiched from the upper and lower sides by the stripping edges 14. Then, an ultrasonic wave vibration is exerted on the cutter unit 11 by an ultrasonic wave oscillator 12, and the cutter edges of the cutter unit 11, performing the ultrasonic wave vibration, cut the incisions into the jacket 2. At this time, the cutter unit 11 cuts the incisions, while being moved in a direction perpendicular to the core wire of the flat-type multicore cable 1 by the cutter unit sending mechanism 13. Since an upper unit and a lower unit of the cutter unit are installed being shifted back and forth by about 0.5 mm to each other in the core wire direction, it turns out that a position of the incisions is shifted by about 0.5 mm between upper and lower parts of the jacket 2. Moreover, the stripping edges 14 sandwiching the jacket 2 are retreated back in parallel to the core wire direction, thereby performing the stripping of the jacket 2 from the inner insulating layers 5 and the grounding core wires 4. Concerning the cable 1 to which the stripping is over, since the position of the incisions is shifted between the upper and the lower Darts of the jacket 2 as is shown in FIG. 1, the lower halfs of the shields remain and are exposed to the outside as is shown in FIG. 3.

Next, the exposed inner insulating layers 5 are cut using a $CO_2$ laser at a position about 1 mm apart from the positions of the incisions into the jacket 2. Furthermore, as is the case with the jacket 2, a mechanical edge is cut into inner jackets, i.e. the inner insulating layers 5, and then the mechanical edge is retreated back in parallel to the core wire direction, thereby exposing the signaling core wires 6.

Furthermore, in order to fit an arrangement of the terminals 9 of the connector 8, the signaling core wires 6 and the grounding core wires 4 are formed by means of formation molds, and then the connection with the terminals 9 of the connector 8 are performed using methods such as a resistance welding.

The following steps will be explained below, using FIG. 7.

Figure 7:
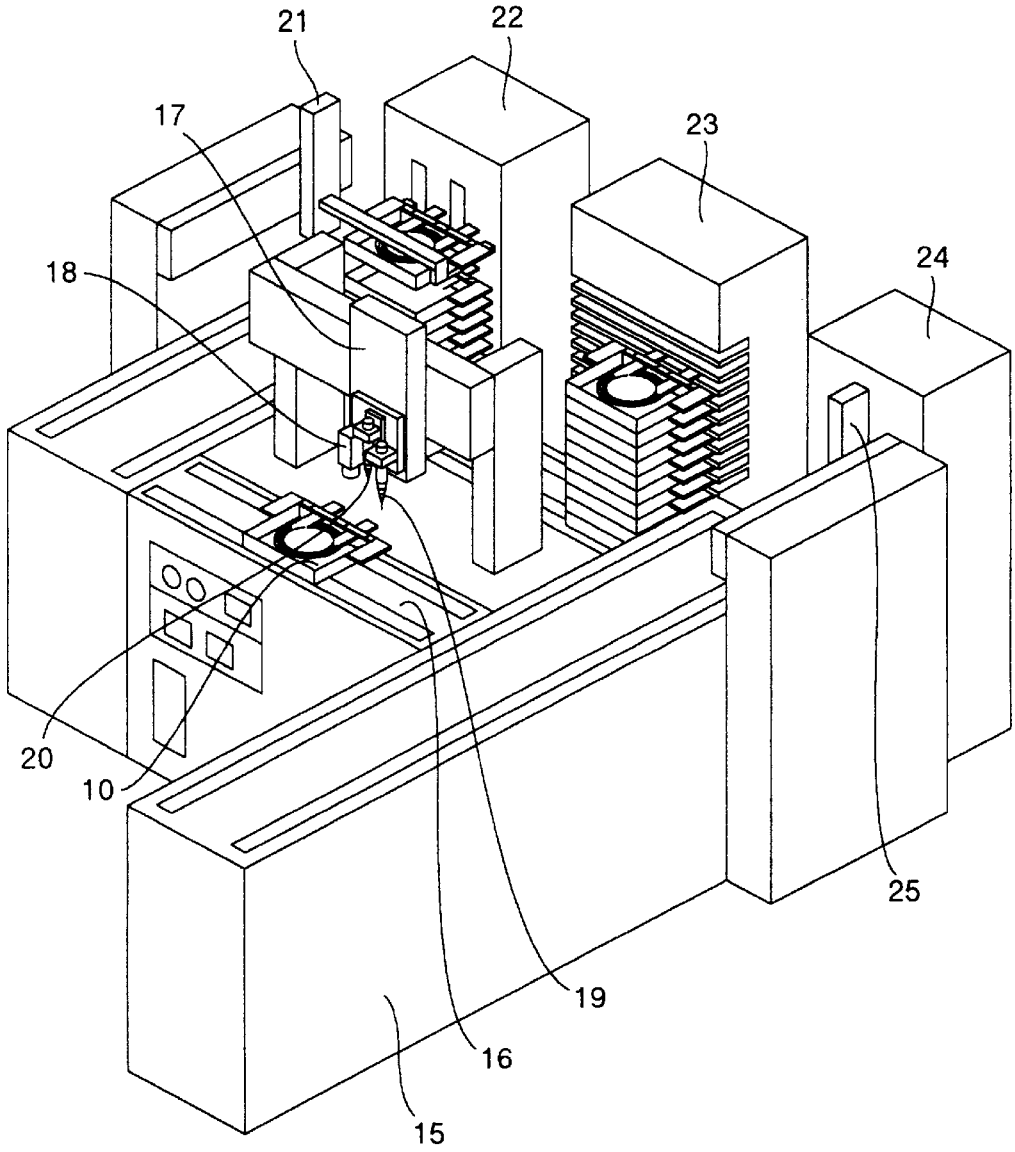
FIG. 7 is a perspective view of an electrically conductive adhesive coating apparatus, i.e. an embodiment in the present invention.

FIG. 7 is a perspective view of an electrically conductive adhesive coating apparatus for coating the exposed shields 3 and the grounding core wires 4 with the electrically conductive adhesive 7 and for drying the electrically conductive adhesive 7. The electrically conductive adhesive coating apparatus comprises an image recognition device 18 for recognizing an outside appearance of the flat-type multicore cable 1 so as to perform position alignment, a dispenser 19 for ejecting the electrically conductive adhesive 7 by a fixed quantity, an X-Y-Z robot 17 for moving the image recognition device 18 and the dispenser 19, an ultrasonic wave vibrator 20 for exerting an ultrasonic wave vibration on the flat-type multicore cable 1, a stacking robot 21 for stacking the pallets, a thermosetting unit 23 for hardening the electrically conductive adhesive 7 with which the coating is performed, and so on.

When position alignment of the multicore cable 1 is performed on a cable-specified pallet 10 and the apparatus is started up with the cable-specified pallet 10 set on a loader 15, the cable-specified pallet 10 is transferred by the loader 15 to a portion to be coated. Moreover, after the setting of the multicore cable 1 is performed using a clamp, the image recognition device 18 recognizes the position of the incisions into the flat-type multicore cable 1 and a pitch between the grounding core wires 4. After that, following the recognized data, ON/OFF of the ejection is carried out repeatedly with the dispenser 19 being moved by the X-Y-Z robot 17, thereby performing the coating of the electrically conductive adhesive 7 by a predetermined quantity in such a manner as to cover a grounding core wire 4 and the exposed part of a shield 3 as is shown in FIG. 3.

Next, the position of the grounding core wire 4 is determined using the above-described recognized data, and with the ultrasonic wave vibrator 20 pressed against the grounding core wire 4, the ultrasonic wave vibration is exerted. The ultrasonic wave vibration eliminates oxide films of the shield 3 and the grounding core wire 4. Furthermore, the ultrasonic wave vibration causes the electrically conductive adhesive 7 to penetrate into a clearance between the grounding core wire 4 and the shield 3, thus making it possible to attain a secure connection between them.

In addition, a plurality of cable-specified pallets 10 are transferred by a conveyor to a stacking unit, and are stacked by the stacking robot 21 onto a stacking lifter 22. The cable-specified pallets 10, which are stacked on the stacking lifter 22, are moved to the thermosetting unit 23 when they are stacked in a predetermined number of steps.

The thermosetting unit 23 is constituted by installing thermointerrupting plates on cylindrical far-infrared rays heaters arranged with an equal spacing in a vertical direction. So as not to exert an influence of the heat upon the multicore cable 1, the thermosetting unit 23 heats, for a predetermined time and locally, each of the portions coated with the electrically conductive adhesive 7, thereby drying and hardening the electrically conductive adhesive 7.

Finally, after the electrically conductive adhesive 7 is dried, the cable-specified pallets 10 are transferred to an unstacked lifter 24, and are, one by one, set on the loader by an unstacked robot 25, thus finishing the sequence of operations.

The present invention makes it possible to securely connect the grounding core wires with the shields regardless of a structure of the cable, thus allowing the characteristic impedance of the cable to be stabilized.

Figure 9:
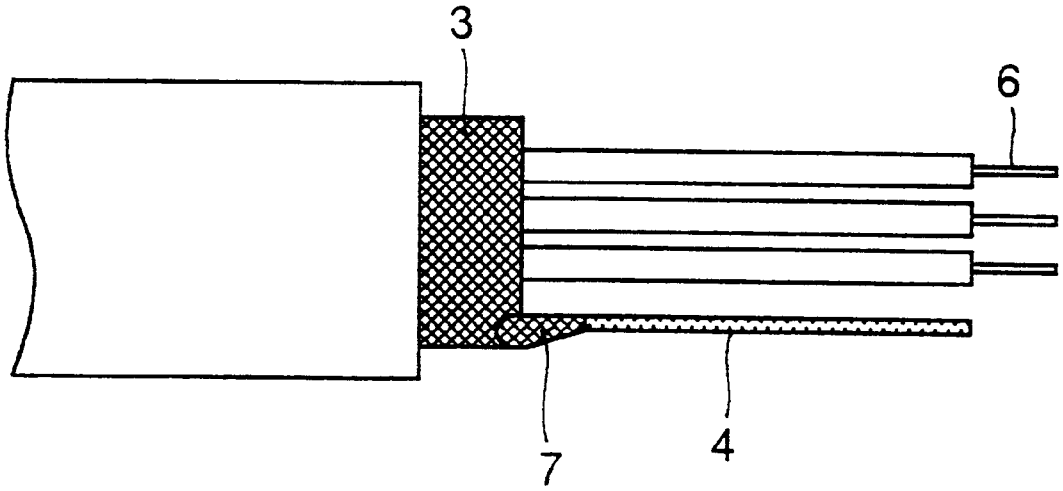
FIG. 9 is a schematic view of a multicore cable in which there are a plurality of signaling core wires within the inner insulating layers.

For example, as shown in FIG. 9, even in the multicore cable in which there are a plurality of signaling core wires 6 within the inner insulating layers 5, the above-described method makes it possible to securely connect the grounding core wires 4 with the shields 3. Namely, the present invention, being not limited to the flat-type multicore cable, brings about a technique which allows a stable characteristic impedance to be obtained even in the case of the multicore cable in which a plurality of signaling core wires are located in parallel, and thus is applicable regardless of a configuration of the cable.

What is claimed is:

1. A multicore cable having a plurality of cables in parallel, each of said plurality of cables being formed by winding a shield around a signaling core wire, which is covered with an insulating material, and a grounding core wire, wherein said grounding core wire and said shield are bonded with an electrically conductive material in a cut portion of said cables;

wherein said cut portion of said multicore cable forms a stair portion; and wherein said stair portion is formed in a cut portion of said shield.

2. A multicore cable comprising:

parallel plurality of signaling core wires;

an insulating material which covers each of said signaling core wires;

at least one grounding core wire;

a shield which is around said grounding core wire and said signaling core wires covered by said insulating material;

a jacket which is made of an insulating material; and wherein a stair portion is formed in said shield.

3. The multicore cable as claimed in claim 2, wherein no oxide film is formed on contact surfaces of said grounding core wire and said shield.

4. The multicore cable as claimed in claim 2, wherein said grounding core wire and said shield are bonded with an electrically conductive adhesive in a cut portion of said shield.

5. The multicore cable as claimed in claim 2, wherein said electrically conductive material is an electrically conductive adhesive.

6. The multicore cable as claimed in claim 5, wherein said electrically conductive adhesive comprises an electrically conductive metal particle and an epoxy series resin.

7. The multicore cable as claimed in claim 5, wherein viscosity of said electrically conductive adhesive in a liquid state is equal to 125 Pa·s or less.

8. The multicore cable as claimed in claim 2, wherein said stair portion is a stair difference.

9. The multicore cable as claimed in claim 2, wherein said cable is cut such that said shield emerges at said jacket.

* * * * *